US009789599B2

(12) United States Patent
Kumar

(10) Patent No.: US 9,789,599 B2
(45) Date of Patent: Oct. 17, 2017

(54) VARIABLE SPEED CONTROL OF FLUID DRIVEN TOOLS

(71) Applicant: Ingersoll-Rand Company, Davidson, NC (US)

(72) Inventor: Sanjeev Kumar, Bangalore (IN)

(73) Assignee: Ingersoll-Rand Company, Davidson, NC (US)

( * ) Notice: Subject to any disclaimer, the term of this patent is extended or adjusted under 35 U.S.C. 154(b) by 817 days.

(21) Appl. No.: 13/958,317

(22) Filed: Aug. 2, 2013

(65) Prior Publication Data

US 2014/0034349 A1 Feb. 6, 2014

Related U.S. Application Data

(60) Provisional application No. 61/679,038, filed on Aug. 2, 2012.

(51) Int. Cl.

| | |
|---|---|
| ***F01C 13/00*** | (2006.01) |
| ***B25F 5/00*** | (2006.01) |
| ***F01C 13/02*** | (2006.01) |
| ***F01C 20/08*** | (2006.01) |
| ***F01C 21/18*** | (2006.01) |

(52) U.S. Cl.

CPC ..... *B25F 5/005* (2013.01); *F01C 13/02* (2013.01); *F01C 20/08* (2013.01); *F01C 21/186* (2013.01)

(58) Field of Classification Search

CPC .. B25F 5/00; B25F 5/005; F01C 13/02; F01C 20/12; F01C 20/08; F01C 21/186; F16K 11/14

USPC ..... 173/221, 169

See application file for complete search history.

(56) References Cited

U.S. PATENT DOCUMENTS

| | | | | |
|---|---|---|---|---|
| 2,995,114 A | | 8/1961 | Starr | |
| 3,326,240 A | * | 6/1967 | McConnaughay | B25B 21/00 137/630.14 |
| 3,635,605 A | * | 1/1972 | Hall | B23B 45/04 123/387 |
| 4,024,892 A | * | 5/1977 | Prisco | B25B 21/00 137/630.14 |

(Continued)

OTHER PUBLICATIONS

International Search Report for PCT/US2013/053494 dated Nov. 8, 2013, 2 pages.

(Continued)

*Primary Examiner* — Andrew M Tecco
*Assistant Examiner* — Chelsea Stinson
(74) *Attorney, Agent, or Firm* — Taft Stettinius & Hollister LLP

(57) ABSTRACT

An apparatus is disclosed that includes a fluid inlet in fluid communication with a valve assembly, the valve assembly structured to selectively permit the flow of a motive fluid from the fluid inlet to a fluid driven motor, and wherein the valve assembly further includes a first plunger and a second plunger, one of the first plunger and the second plunger including a plurality of axially incorporated fluid channels, wherein the plunger including a plurality of axially incorporated fluid channels is structured to be selectively driven by an actuator such that as the plunger including a plurality of axially incorporated fluid channels is axially displaced away from a first position the number of axially incorporated fluid channels in fluid communication with the fluid inlet and the fluid driven motor increases.

12 Claims, 7 Drawing Sheets

(56) References Cited

U.S. PATENT DOCUMENTS

| | | | | |
|---|---|---|---|---|
| 4,380,270 | A * | 4/1983 | Ludwig | F03B 13/00 173/221 |
| 4,476,942 | A * | 10/1984 | Elkin | B25F 5/00 173/168 |
| 5,797,462 | A * | 8/1998 | Rahm | B25B 21/00 173/169 |
| 5,918,686 | A * | 7/1999 | Izumisawa | B25B 21/00 173/169 |
| 6,161,628 | A * | 12/2000 | Liu | B25D 9/20 173/114 |
| 6,443,239 | B1 * | 9/2002 | Izumisawa | B25B 21/02 173/168 |
| 6,902,011 | B2 * | 6/2005 | Hall | B25B 23/1453 173/168 |
| 7,311,155 | B2 * | 12/2007 | Chang | B25F 5/00 173/104 |
| 7,461,704 | B2 * | 12/2008 | Chen | B25F 5/00 173/169 |
| 9,555,532 | B2 * | 1/2017 | Amend | B25B 21/026 |
| 2006/0278416 | A1 | 12/2006 | Tanji | |
| 2007/0011884 | A1 | 1/2007 | Hua et al. | |
| 2010/0300716 | A1 * | 12/2010 | Amend | B25B 21/026 173/93 |
| 2012/0055690 | A1 | 3/2012 | Uemura | |
| 2014/0034345 | A1 * | 2/2014 | Kumar | B25F 5/005 173/169 |
| 2016/0075008 | A1 * | 3/2016 | Wu | B25F 5/001 173/221 |

OTHER PUBLICATIONS

Written Opinion of the International Searching Authority for PCT/US2013/053494.

European Extended Search Report; European Patent Office; European Application No. 13824748.1; dated Jun. 30, 2016; 10 pages.

* cited by examiner

VARIABLE SPEED CONTROL OF FLUID DRIVEN TOOLS

CROSS REFERENCE TO RELATED APPLICATIONS

The present application claims the benefit of U.S. Provisional Patent Application No. 61/679,038, filed Aug. 2, 2012, and is incorporated herein by reference.

FIELD OF THE INVENTION

The present invention generally relates to fluid driven tools, and more particularly, but not exclusively, to variable motor speed control of fluid driven tools.

BACKGROUND

Speed control of fluid powered motors, specifically in the area of fluid driven power tools remains an area of interest. Many current designs permit the fluid driven tool to provide maximum flow to the motor and maximum speed to the tool output, immediately after a flow of fluid from an inlet valve is permitted. Therefore, further technological developments are desirable in this area.

SUMMARY

One embodiment of the present invention is a unique speed control device providing variable speed motor control for fluid driven tools. Other embodiments include apparatuses, systems, devices, hardware, methods, and combinations for motor speed control for fluid driven tools. Further embodiments, forms, features, aspects, benefits, and advantages of the present application shall become apparent from the description and figures provided herewith.

BRIEF DESCRIPTION OF THE DRAWINGS

The description herein makes reference to the accompanying figures wherein like reference numerals refer to like parts throughout the several views, and wherein.

DETAILED DESCRIPTION OF THE DRAWINGS

Figure 1:
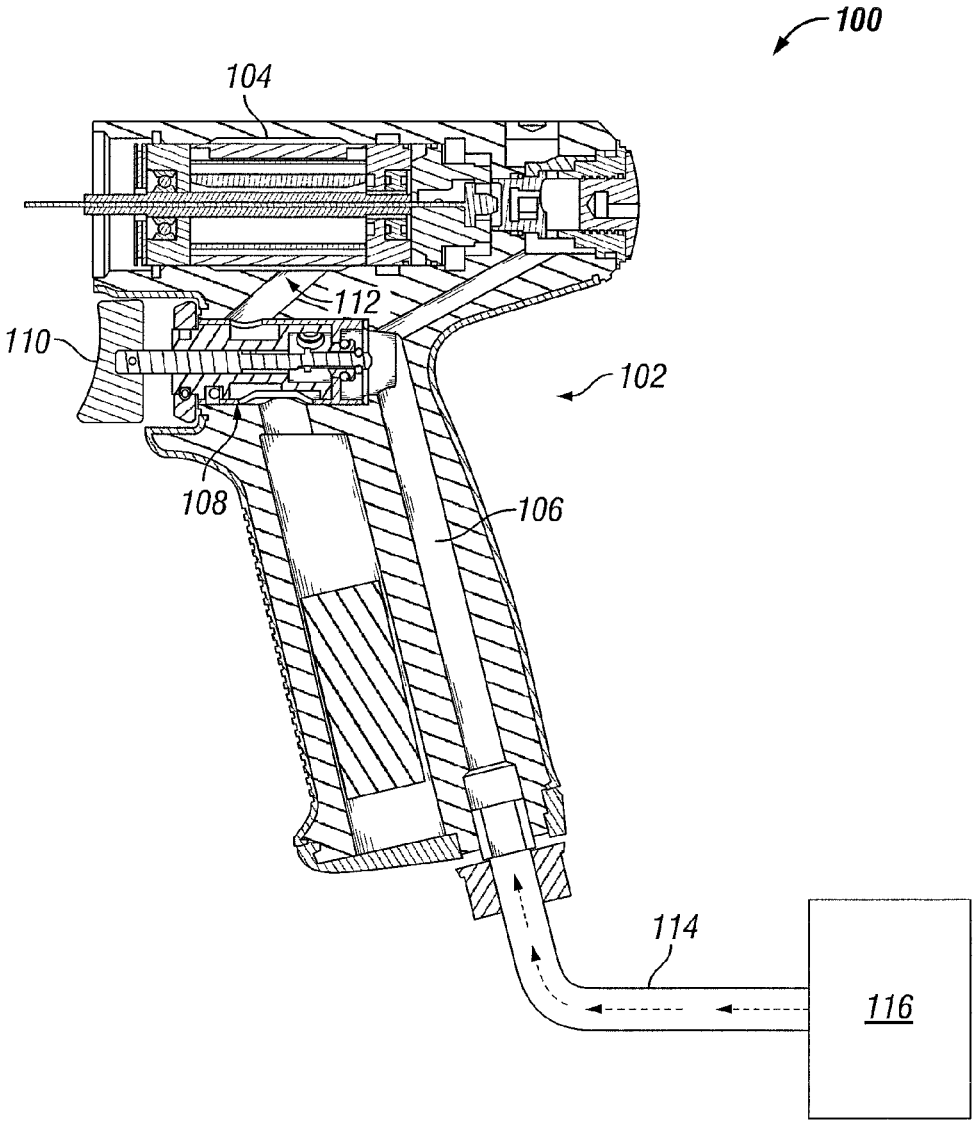
FIG. 1 depicts an embodiment of a fluid driven tool including a variable valve assembly.

For purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

With reference to FIG. 1, one embodiment is disclosed of a fluid powered device 100 including a housing 102 and a fluid driven motor 104. It is contemplated that the fluid powered device 100 may include a variety of fluid powered devices such as pumps, actuators, grain dryers, or any other fluid powered device 100. In some embodiments, fluid powered device 100 can be a power tool, including but not limited to a drill, chisel, grinder, or the like. The fluid driven motor 104 can be any device which is capable of extracting the potential energy in a pressurized fluid and converting the energy into mechanical motion such as rotational or linear motion.

The motive fluid 114 can be any fluid capable of pressurization including, but not limited to, hydraulic fluid, water, or gases. FIG. 1 illustrates air 114 as the motive fluid, which is received from a pressure source 116, illustrated as an air compressor. Pressure source 116 may include any number of pumps, compressors, turbines, pressurized tanks, or any other device which is capable of exerting or retaining pressure on the motive fluid 114.

The housing 102 further includes a fluid inlet 106 which allows a motive fluid 114 to pass into a valve assembly 108. The valve assembly 108 is operated by an actuator 110. The actuator 110 may take a variety of forms including, but not limited to, electronic or manual actuators such as push buttons, hall effect sensors, or the like. In one embodiment, illustrated in FIG. 1 the actuator 110 is a trigger. In some forms, a portion of the fluid inlet 106 and an inlet of the valve assembly 108 are perpendicular or approximately perpendicular.

Figure 2A:
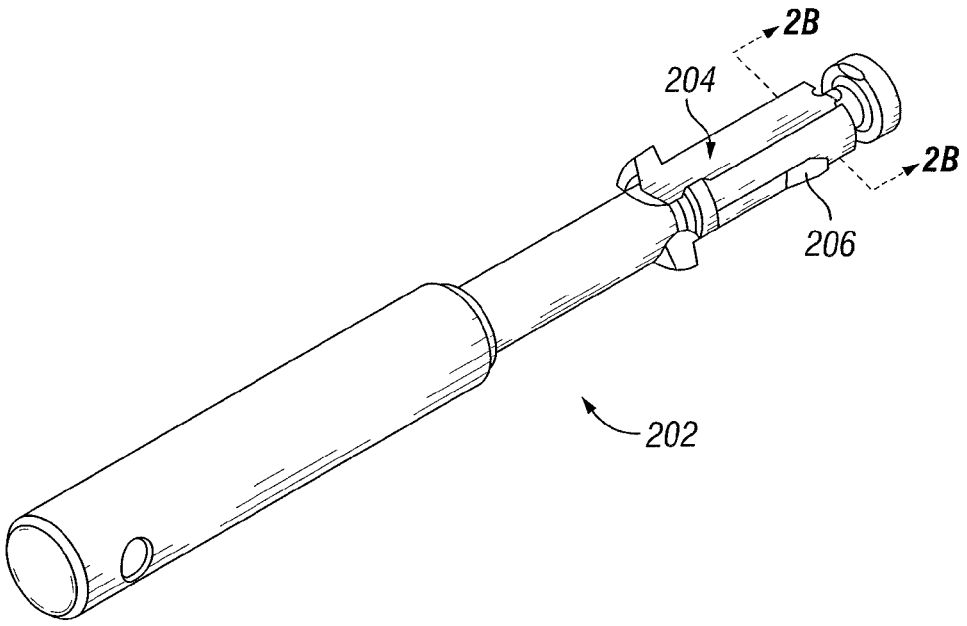
FIGS. 2A-2B depict an embodiment of a plunger including a plurality of axially disposed fluid channels.
Figure 2B:
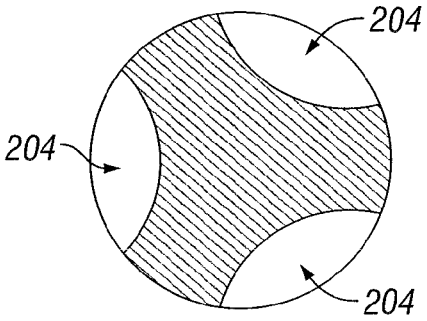

The valve assembly 108 permits the selective release of the motive fluid 114 from the fluid inlet 106 to an inlet 112 of the fluid driven motor 104. Referring to FIG. 2, the valve assembly 108 includes at least one plunger 202. Plunger 202 includes a plurality of axially extending fluid channels 204. The axially extending fluid channels 204 may be grooves in the plunger 202, apertures disposed within the plunger 202, or any other passageway which permits the flow of fluid from one end of the axially extending fluid channel 204 to the other. While FIG. 2 illustrates three axially extending fluid channels 204, any number of axially extending fluid channels 204 may be incorporated into the plunger 202 depending upon the application, manufacturing capabilities, and any cost to benefit analysis associated therewith. As will be explained below, the number of axially extending fluid channels 204 is directly related to the number of speeds which the fluid driven motor 104 may operate at.

Each of the plurality of axially extending fluid channels 204 include a fluid intake 206. The fluid intakes 206 are disposed axially and radially in relation to each of the other fluid intakes 206. As the plunger 202 is moved linearly, a first fluid intake 206 will place the fluid inlet 106 (and motive fluid 114 contained therein) in flow communication with the fluid driven motor 104. The motive fluid 114 will pass from the fluid inlet 106, through the fluid intake 206, traverse the axially extending fluid channel 204, and enter the fluid driven motor 204 through the inlet of the fluid driven motor 112.

FIG. 4 illustrates the variation in the amount of motive fluid 114 which is provided to the fluid driven motor 104 in a number of actuator 110 positions. When the actuator 110 is not depressed, the plungers 202 blocks the fluid intake 206 and effectively prevent the release of motive fluid 114 to the fluid driven motor 104. Only one plunger is being discussed but it is contemplated herein that multiple plungers may be utilized in embodiments of the present invention. When the actuator 110 is depressed to a first position, the actuator moves the plunger 202 to a first position and the motive fluid 114, received from the fluid inlet 106, enters a fluid intake 206 of a first axially extending fluid channel 204, and the motive fluid 114 can then be directed to the fluid driven motor 104. As the actuator 110 continues to be depressed, the plunger 202 is directed to a second position where a second axially extending fluid channel 204 is also placed in flow communication with the fluid inlet 106. In this second position, the motive fluid 114 received from the fluid inlet 106 traverses both the first and second axially extending fluid channels 204 and is directed toward the fluid driven motor 104.

The total motive fluid flow 114, which is directed toward the fluid driven motor 104, is the combined total of the motive fluid flow 114 through each of the axially extending fluid channels 204 which are in flow communication with the fluid inlet 106. Furthermore, the greater the number of axially extending fluid channels 204, the greater the number of speeds at which the fluid driven motor 104 can be operated. As the actuator 110 is depressed further, the plunger is moved to a third location where a third axially extending fluid channel 204 is additionally placed in flow communication with the fluid inlet 106. At this location, the motive fluid 114 traverses from the fluid inlet 106 through the first, second, and third axially extending fluid channels 204 to the fluid driven motor 104.

Figure 3:
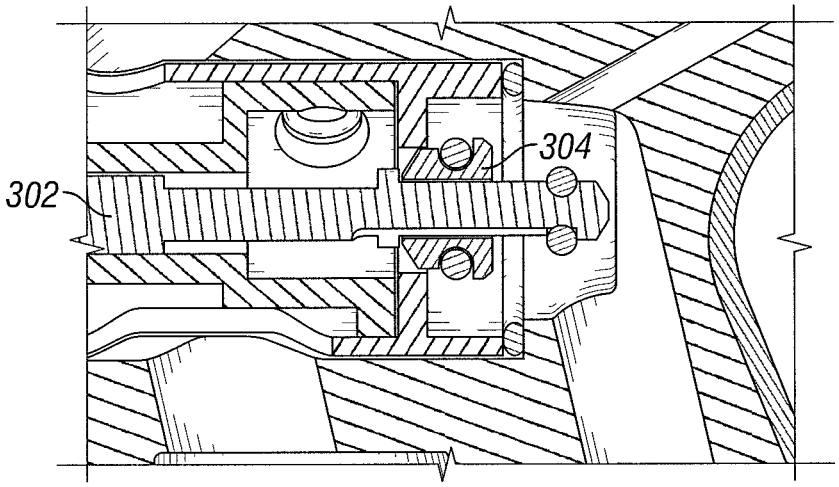
FIG. 3 depicts an embodiment of a plunger assembly in a fluid driven tool.
Figure 4A:
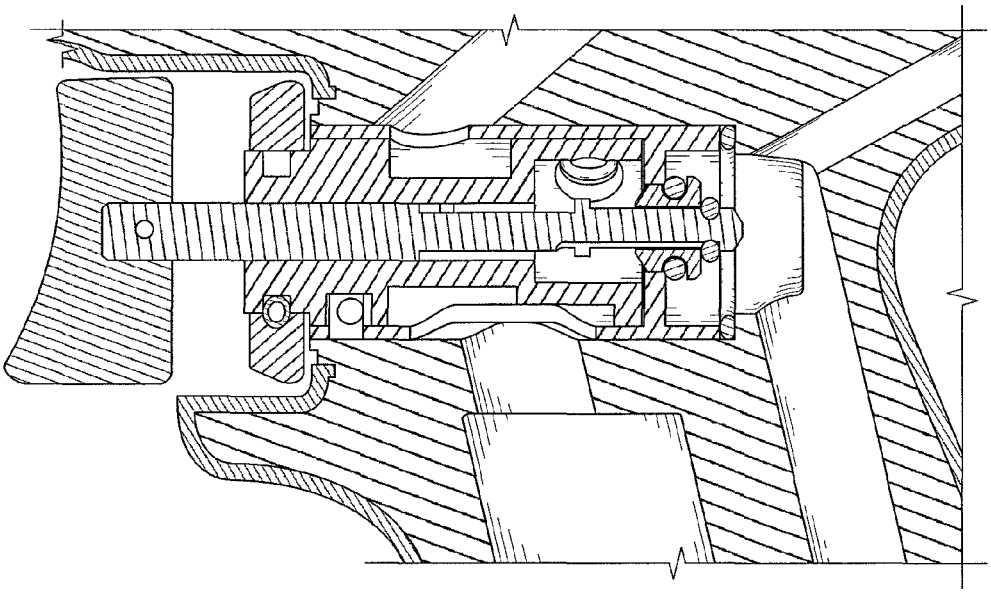
FIGS. 4A-4D and 5A-5B depict the plunger assemblies at a variety of actuator positions.
Figure 4B:
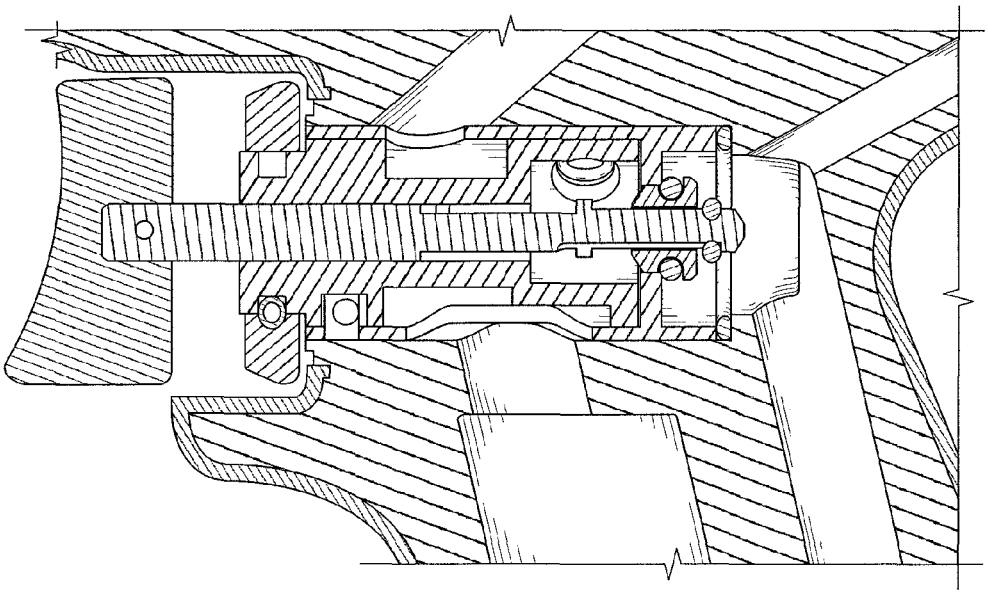
Figure 4C:
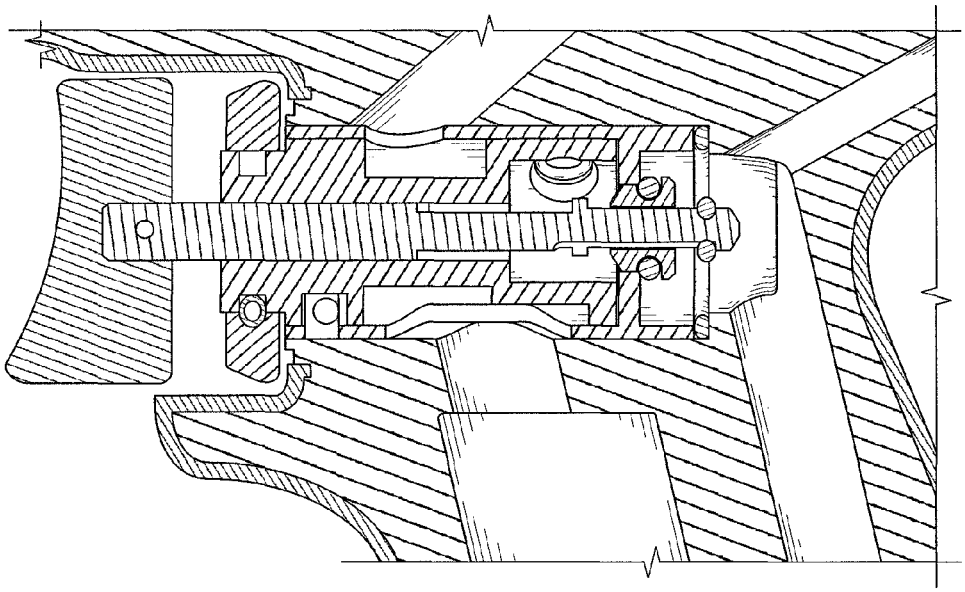
Figure 4D:
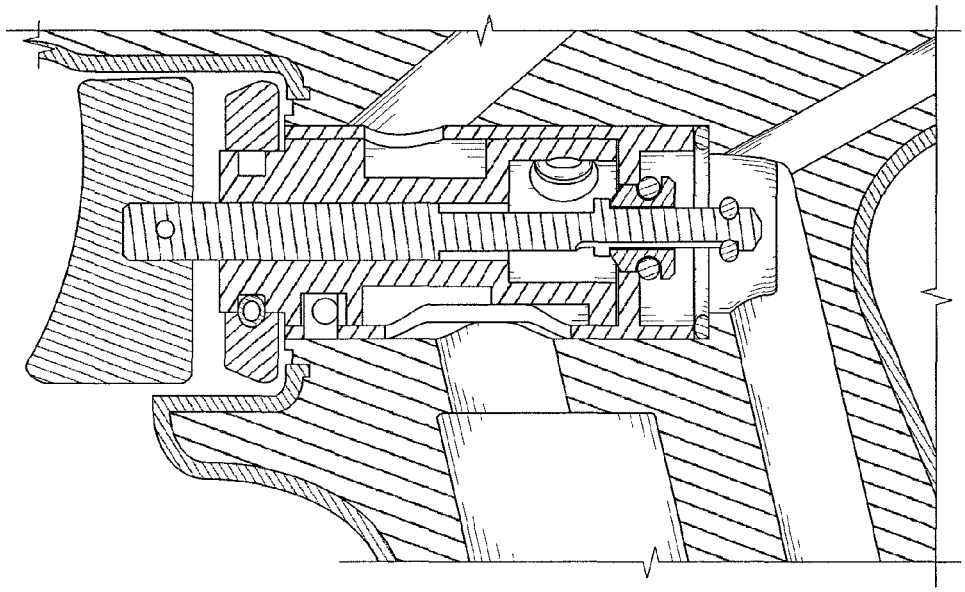
Figure 5A:
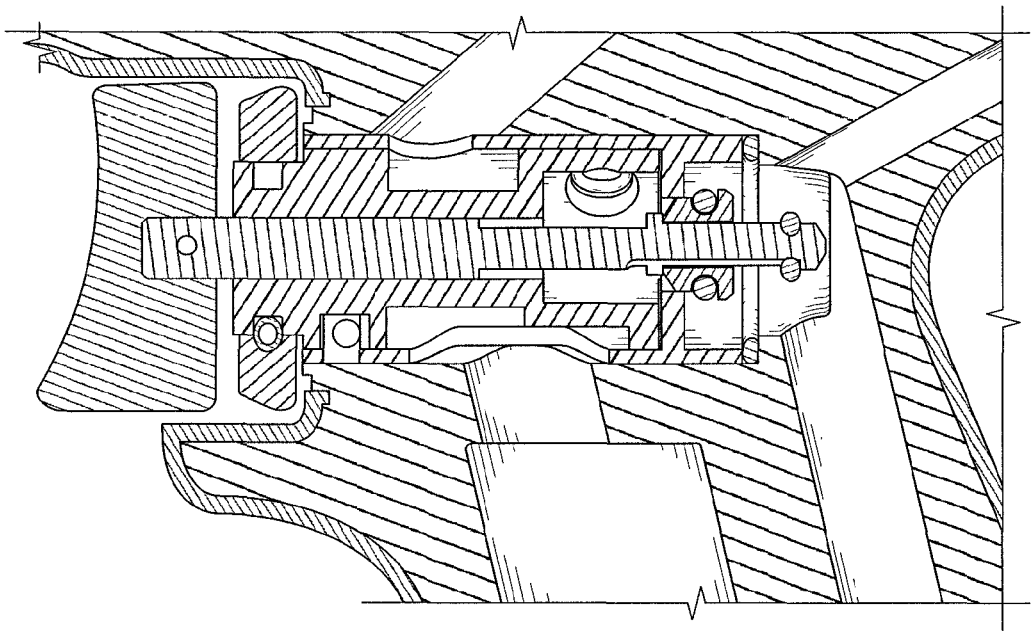
Figure 5B:
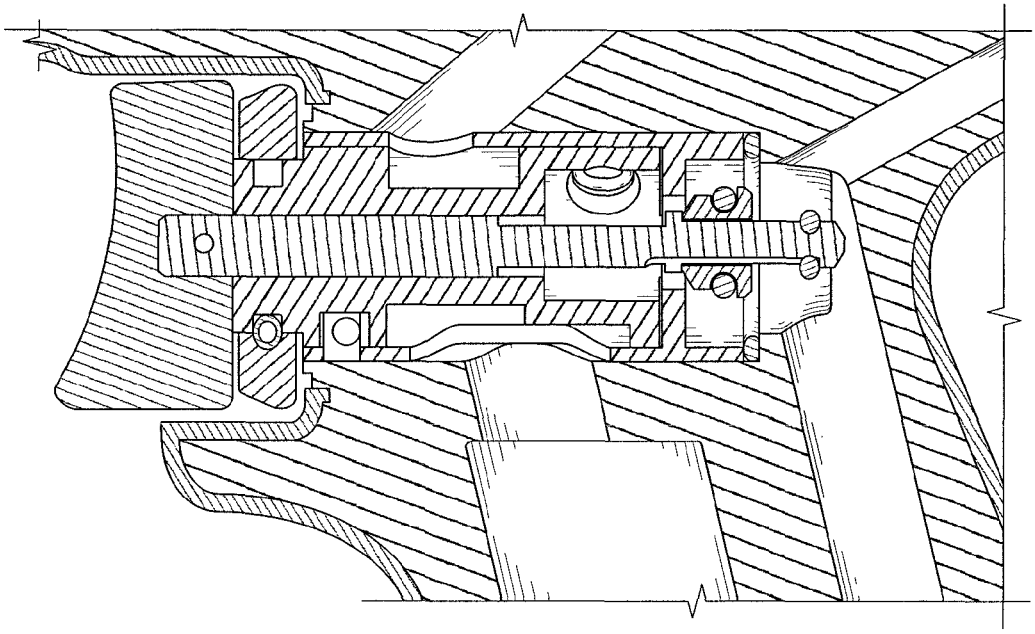
Figure 6:
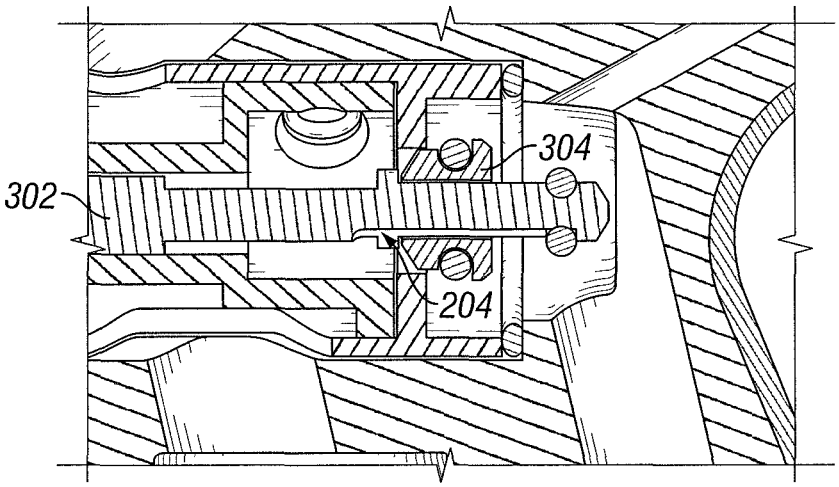
FIG. 6 depicts an embodiment of a plunger assembly in which a plurality of plungers include axially disposed fluid channels.

Referring to FIG. 3, a valve assembly 108 is illustrated with a first plunger 302 and a second plunger 304. In certain embodiments, it is contemplated that a plurality of plungers may be utilized depending on the constraints of the application. Referring to FIG. 5, when the motive fluid 114 is traversing all of the axially extending fluid channels 204 located in the first plunger 302, continued depression of the actuator 110 results in linear movement of the second plunger 304. In one embodiment of the present invention, the linear movement of the second plunger 304 results in a fully open position of the valve assembly 108, permitting a maximum flow of the motive fluid 114 to the fluid driven motor 104. In a further embodiment of the present invention, illustrated as FIG. 6, the second plunger 304 may also contain a plurality of axially extending fluid channels 204, through which the motive fluid 114 traverses upon the linear displacement of the second plunger 304, as was discussed with reference to the first plunger 302.

While the invention has been described in connection with what is presently considered to be the most practical and preferred embodiment, it is to be understood that the invention is not to be limited to the disclosed embodiment(s), but on the contrary, is intended to cover various modifications and equivalent arrangements included within the spirit and scope of the appended claims, which scope is to be accorded the broadest interpretation so as to encompass all such modifications and equivalent structures as permitted under the law. Furthermore it should be understood that while the use of the word preferable, preferably, or preferred in the description above indicates that feature so described may be more desirable, it nonetheless may not be necessary and any embodiment lacking the same may be contemplated as within the scope of the invention, that scope being defined by the claims that follow. In reading the claims it is intended that when words such as "a," "an," "at least one" and "at least a portion" are used, there is no intention to limit the claim to only one item unless specifically stated to the contrary in the claim. Further, when the language "at least a portion" and/or "a portion" is used the item may include a portion and/or the entire item unless specifically stated to the contrary.

What is claimed is:

1. An apparatus, comprising:

a housing including a fluid driven motor and a fluid inlet, the fluid inlet in selective fluid communication with the fluid driven motor;

a valve assembly in fluid communication with the fluid inlet and the fluid driven motor, wherein the valve assembly further includes a first plunger including a plurality of axially disposed fluid channels, the plunger configured to be slidable relative to a cover member having a cover side that encircles the first plunger, wherein each axially disposed fluid channel includes a fluid intake disposed axially offset in relation to each of the other fluid intakes of the other fluid channels;

an actuator structured to selectively displace the first plunger relative to the cover member from a first location to a second location wherein a fluid intake of a first axially disposed fluid channel is uncovered from engagement with the cover side of the cover member as a result of relative movement between the plunger and the cover member such that the first axially disposed fluid channel is in fluid communication with the fluid inlet and an inlet of the fluid driven motor; and wherein the actuator is further structured to selectively displace the first plunger relative to the cover member from the second location toward a third location wherein a fluid intake of a second axially disposed fluid channel is uncovered from engagement with the cover side of the cover member as a result of relative movement between the plunger and the cover member such that the second axially disposed fluid channel is additionally in fluid communication with the fluid inlet and the inlet of the fluid driven motor, and wherein the fluid intake of the second axially disposed fluid channel is covered and does not flow fluid when the plunger is in the second location.

2. The apparatus of claim 1, wherein the actuator is further structured to selectively displace the first plunger from the third location to a plurality of locations, each location corresponding with a position at which another of the plurality of fluid intakes is placed in fluid communication with the fluid inlet and the inlet of the fluid driven motor.

3. The apparatus of claim 1, further including a second plunger selectively displaced by the actuator, the second plunger forming the cover member and an inner portion of the second plunger forming the cover side of the cover member, the second plunger structured to permit additional fluid flow from the fluid inlet to the inlet of the fluid driven motor.

4. The apparatus of claim 3, the second plunger including a plurality of axially disposed fluid channels.

5. The apparatus of claim 1, wherein the fluid is air and wherein the fluid inlet is in fluid communication with a source of fluid pressurization.

6. The apparatus of claim 5, wherein the housing further defines an air driven power tool.

7. The apparatus of claim 3, wherein a maximum fluid flow received by the fluid driven motor from the displacement of the second plunger exceeds a maximum fluid flow received by the fluid driven motor from the displacement of the first plunger.

8. An apparatus, comprising:

a fluid inlet in fluid communication with a valve assembly, the valve assembly structured to selectively permit the flow of a motive fluid from the fluid inlet to a fluid driven motor; and wherein the valve assembly further includes a first plunger and a second plunger, one of the first plunger and the second plunger including a plurality of axially incorporated fluid channels each having a respective inlet axially offset from the inlets of the other fluid channels, and wherein the inlets can be selectively uncovered by axial movement of the fluid channels relative to a first surface of a cover member, wherein the inlets are progressively uncovered by the first surface of the cover member as the inlets are progressively moved along an axial direction, wherein the plunger including a plurality of axially incorporated fluid channels is structured to be selectively driven by an actuator such that as the plunger including a plurality of axially incorporated fluid channels is axially displaced away from a first position the number of axially fluid channels in fluid communication with the fluid inlet and the fluid driven motor increases.

9. The apparatus of claim 8, wherein the second plunger is structured to be selectively driven by the actuator to place the fluid inlet in fluid communication with the fluid driven motor when all of the plurality of axially incorporated fluid channels are in fluid communication with the fluid inlet and the fluid driven motor.

10. The apparatus of claim 9, wherein the second plunger includes a plurality of axially incorporated fluid channels.

11. The apparatus of claim 8, wherein the motive fluid is air and wherein the fluid driven motor, the fluid inlet, and the valve assembly further define a portion of a power tool.

12. The apparatus of claim 8, wherein a portion of the fluid inlet and an inlet of the valve assembly are approximately perpendicular.

* * * * *